United States Patent [19]

Edwards

[11] 4,088,174

[45] May 9, 1978

[54] SHOWER CURTAIN ANCHOR ATTACHMENT

[76] Inventor: Douglas P. Edwards, Meadowbrook Rd., Carlisle, Mass. 01741

[21] Appl. No.: 822,430

[22] Filed: Aug. 8, 1977

[51] Int. Cl.[2] ..... E06B 3/92

[52] U.S. Cl. ..... 160/349 R; 4/149

[58] Field of Search ..... 160/345, 346, 347, 349 R, 160/349 D, 220; 4/149, 153, 154; 248/73, 207, 223.4, 224.2, 307, 480, 500, 507

[56] References Cited

U.S. PATENT DOCUMENTS

| | | | |
|---|---|---|---|
| 2,562,029 | 7/1951 | Fridolph | 160/330 |
| 2,894,576 | 7/1959 | Williams | 160/220 |
| 2,901,037 | 8/1959 | Yohner | 160/346 |
| 3,090,072 | 5/1963 | Fridolph | 160/345 |
| 3,190,599 | 6/1965 | Margulis | 248/223.4 |
| 3,730,612 | 5/1973 | Arroto et al. | 248/480 |

*Primary Examiner*—Peter M. Caun

*Attorney, Agent, or Firm*—James J. Cannon, Jr.

[57] ABSTRACT

A simplified apparatus to retain and guide the lower edge of a conventional shower curtain in relation to the inner surface of a shower or bathtub enclosure, consisting of a flexible, rectangularly-shaped, flat, elongated C-shaped track, having a T-shaped guide channel running throughout its entire length, which serves to both guide and mount discrete curtain anchor means attached at spaced intervals to the lower edge of a conventional shower curtain. The shower curtain anchor means consists of circular snap-apart structures, the curtain anchor disc body and disc cover, which are attached to the lower edge of the shower curtain, with a semi-rigid anchor shaft connecting to the anchor disks through a ball joint, and to a circular disc-like track slide, with the track slide means riding in the central guide channel of the C-shaped guide channel track, as the shower curtain is opened or closed.

4 Claims, 3 Drawing Figures

SHOWER CURTAIN ANCHOR ATTACHMENT

BACKGROUND OF THE INVENTION

1. Field of the Invention

This invention relates generally to shower and bathtub enclosures, and more particularly concerns an assembly means for retaining and guiding the lower edge of a shower curtain.

2. Background of the Invention

The literature is replete with prior art devices to retain and guide a shower curtain being used in a stall shower or bathtub enclosure. Most of these prior art means have been designed for guiding the upper edges of the shower curtain. Other devices have required complex costly means to attain the desired result of securing the lower edge of a shower enclosure.

The problems of bathroom floor flooding that occurs when the waterproof shower curtain is placed outside of the lower rim of the shower stall or bathtub enclosure are wide spread and occasionally costly, due to water damage resulting to floors, ceilings, walls and fixtures. These problems usually result from either forgetfulness of the user, or purposeful action, and are especially prevalent in hotels and motels. The person using the shower curtain may want to avoid the curtain being drawn inward against his body while the water is running, thereby creating a partial vacuum.

The object of this invention is to provide a means to mount securely and guide the lower edge of a shower curtain, which means is inexpensive to produce, highly effective and efficient to use.

Another object of the present invention is to provide a simplified and inexpensive means to retain, secure and guide the lower edge of all conventional waterproof shower curtains on the market.

Another object of the present invention is to provide a device that will secure, guide and retain the waterproof shower curtain lower edge, made of polyvinyl or other synthetic material that is durable, flexible, and easily cleaned.

Yet another object of the present invention is to provide a device which will allow minimal friction between the sliding parts in contact, thereby allowing easy and even closing and opening of the shower curtain top and bottom edges.

Still yet another object of the present invention is to provide a flexible guide device that will follow the curved contours of numerous styles of bathtub and shower enclosures, thereby allowing universal utility of the device resulting in total protection to the outside floor area.

Finally, the further object of this invention will be to prevent the disturbing "curtain fluttering" mentioned above, when the lower unattached edge of the conventional shower curtain is retained within the tub enclosure.

Other objects and advantages of the present invention will become apparent to those of ordinary skill in the art as the description thereof proceeds.

SUMMARY OF THE INVENTION

The present invention is an apparatus designed to mount, secure, and retain, and to permit the sliding motion of the lower edge of a conventional waterproof shower curtain in a guide channel track means attached to the inner or rim surface of a conventional shower stall or bathtub enclosure. The device consists of two distinct structures, a single guide channel track means and a plurality of curtain anchor means in order to accomplish the task as described.

A unitary, flexible, rectangularly-shaped, flat, elongated guide channel track means, generally C-shaped and made of a firm yet flexible polyvinyl nylon or similar synthetic material is the primary guiding means of the present apparatus. The guide channel track means is a generally C-shaped structure having an interior guide channel, extending throughout the entire length of the guide channel track means. The guide channel track further has two essentially tapered edges extending the entire length of the guide channel track means designed to carry water and soap away from the rear surface of the guide channel track means. The rear surfaces of the guide channel track and the tapered edges have an adhesive material attached thereto so that the guide channel track may be attached securely to the inner upper surface or rim of a bathtub or shower enclosure. The flexible nature of the guide channel track means allows it to be mounted flush to the contoured and curved surfaces that are characteristic of such bathtub or shower enclosures.

The curtain anchor means are constructed of a material similar in nature to the guide channel track means. The curtain anchor disc attaches at spaced intervals to the lower edge of a conventional waterproof shower curtain. The curtain anchor disc is snap-apart, circular, two-part, wafer-like device consisting of a curtain anchor disc cover which snaps into contact with the curtain anchor disc body thereby gripping the lower edge of the shower curtain between the two parts.

The inner surfaces of both the curtain anchor disc cover and anchor disc body are coated with an adhesive substance which securely adheres to the shower curtain, thereby providing a non-detachable bond between the shower curtain and the curtain anchor disc means.

Attached to the outer surface of the curtain anchor disc body, through a ball joint means, is a semi-rigid anchor connector shaft, which is a narrow shaft of nylon connecting the curtain anchor disc means to the nylon track slide. A ball joint allows multi-directional movement at the point of attachment of the nylon anchor connecting shaft to the curtain anchor disc body to facilitate the sliding movement of the curtain anchor means along the guide channel track means and so that the shower curtain may then be opened and closed smoothly and evenly along both its upper and lower edges. The nylon track slide, rigidly secured to the end of the nylon anchor connecting shaft, is a circular disc-like structure designed to fit loosely within and slide within the guide channel track.

DESCRIPTION OF THE PREFERRED EMBODIMENT

Figure 1:
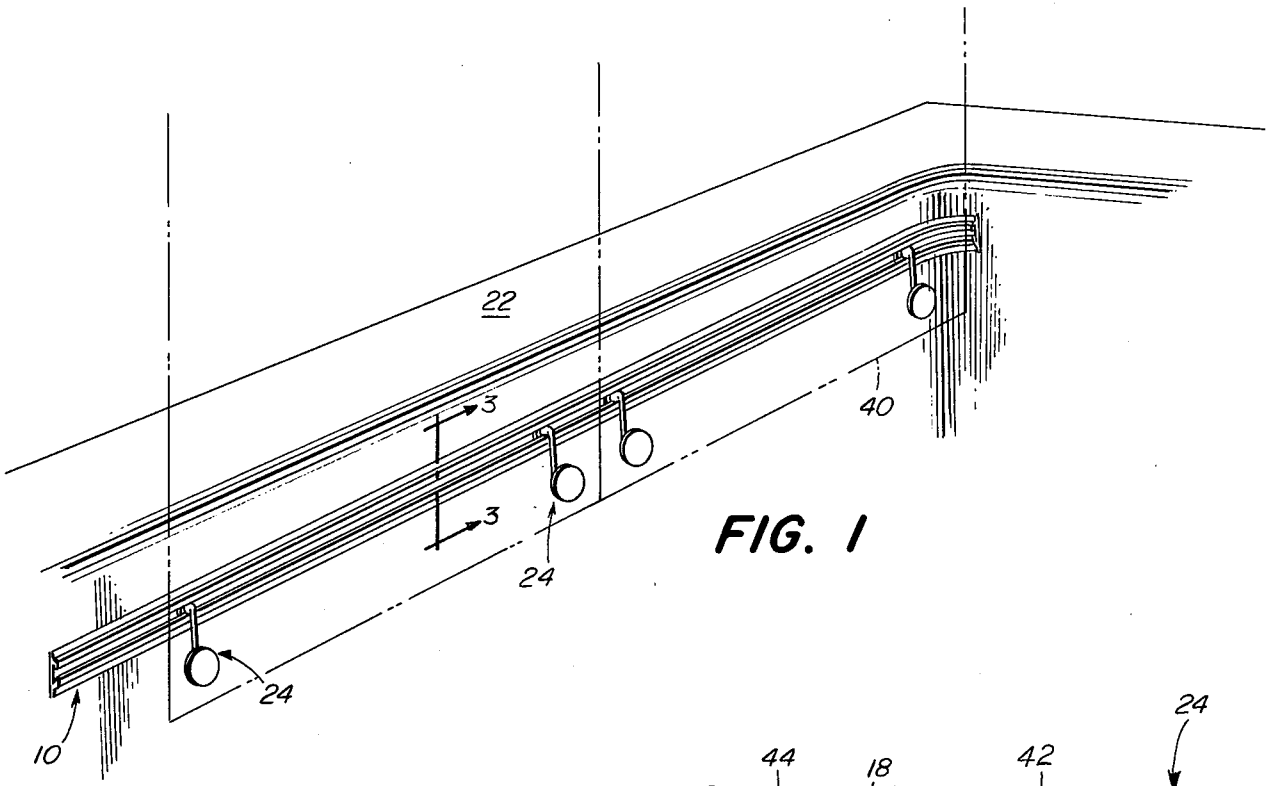
FIG. 1, is a perspective view of the guide channel track means and the curtain anchor means of the present invention in place on the inside of a bathtub enclosure, showing a conventional shower curtain in place.

FIG. 1 is a perspective view of the channel guide track and the shower curtain anchor means of the present invention secured to the upper inside wall of a bathtub, with a conventional shower curtain in place.

Figure 3:
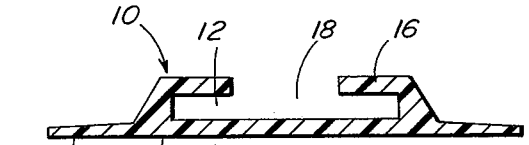
FIG. 3, is a cross-sectional view of the guide channel track means of the present invention, taken along line 3 — 3 of FIG. 1.

FIG. 3, is a cross-sectional view of the guide channel track means of the present invention taken along lines 3 — 3 of FIG. 1. The guide channel track means is designated generally as 10. Guide channel track means 10 is made from a firm yet flexible polyvinyl nylon or similar synthetic material, and is the primary guiding means for the lower edge of a shower curtain of the present invention. Guide channel track means 10 is a flexible C-shaped, elongated, flat structure incorporating an internal centrally-oriented T-shaped guide channel 12. The flexible nature of said guide channel track means 10 allows it to be mounted flush and coplanar to the contoured and curved inner and upper surfaces that are characteristic of bathtub and shower enclosures. Guide channel track means 10 is attached flush to the inner or upper surface of the conventional bathtub enclosure 22 by means of an adhesive affixed to its rear surface 14. The longitudinal front surface 16 of the guide channel track means 10 is parallel to the mounting surface 14 and contains a centrally-placed groove-like channel track opening 18 that extends along the entire length of the guide channel track means 10. The channel track opening 18 of the guide channel track means 10 serves to permit unobstructed movement of the track slide connector to move the anchor shafts of the curtain anchor means to be described later.

Guide channel track means 10 further has two essentially tapered edges 20 oppositely opposed and extending the entire length of the guide channel track 10. These tapered guide track edges 20 are also adhesive backed and serve to carry water and soap away from the rear track mounting surface 14 of the guide channel track 10, thereby allowing the adhesive seal between the guide track channel means 10 and the bathtub enclosure 22 to remain operative for a long period of use.

The curtain anchor means is designated generally as 24, and is constructed of a flexible material, similar in nature to that of the flexible guide channel track means 10. Curtain anchor means 24 includes a curtain anchor disc component consisting of two circular, water-like, snap-apart disc-like components, disc body 26 and disc cover 28. Disc cover 28 has a centrally-oriented protuberance 30 on its inner surface 29. Inner surface 29 of the curtain anchor disc cover 28 is coated with an adhesive material that aids in bonding the curtain anchor means 24 to the conventional shower curtain. Curtain anchor disc body 26 consists of a circular wafer-like disc body 26, whose inner surface 27 is also coated with an adhesive material. Attached to the outer surface of the said anchor disc body 26, is a smaller, centrally-offset, circular, disc-like structure 34 that is mounted coplanar and flush to the outer surface of said anchor disc body 26. A central circular depression 32, is positioned on the inner surface 27 of the said anchor disc body 26, and continues into the body of the centrally-offset circular disc body attachment structure 34. This central circular depression 32 serves to seat the disc cover circular protuberance 30 firmly when the disc cover 28 is connected to the curtain anchor disc body 26. The lower edge region of a conventional shower curtain 40 is mounted at several spaced points to the curtain anchor means 24 by being captured between the curtain anchor disc body 26 and the curtain anchor disc cover 28 as they are pressed and seated together.

A centrally-offset circular depression 38 is located extending from the outer surface of the disc attachment 34, and into the attached curtain anchor disc body 26. This offset depression 38 serves to seat a ball joint 36 which is attached to one end of a thin semi-rigid nylon shaft serving as a track slide connector 42, which extends to a track slide connecting point 44.

At each end of guide channel 12, T-shaped plugs (not illustrated) may be utilized to prevent track slides 46 from falling out of guide channel 12. Preferably said plugs are removable and reusable so that curtain 40 may be removed for cleaning and replaced. Said track slide connecting point 44 mounts to the outer surface of a circular, disc-like structure known as the track slide 46. The ball joint 36 will allow a multi-directional movement at its attachment point in said depression 38, so that the sliding movement of the attached curtain anchor means 24 along the guide channel 12 is readily facilitated, allowing the shower curtain 40 to be both opened and closed smoothly and evenly along both its upper and lower mounting edges.

The track slide 46 is designed to fit within guide channel 12 and slide with minimum friction along the said guide channel 12, as the attached shower curtain 40 is both opened and closed.

In use, the shower curtain anchor attachment of the present invention is simply installed. The guide channel track means 10 is secured to the upper rim or upper inside wall 22 of a bathtub or shower enclosure 22 by means of the adhesive backing on the rear surface 14 of guide channel track means 10. A plurality of curtain anchor means 24 are secured to the lower edge of a shower curtain 40 at spaced intervals by inserting curtain 40 between disc body 26 and disc cover 28. Adhesive coated surfaces 27 and 29 adhere to curtain 40 and protuberance 30 inserted within recess 32 further secures anchor means 24 to curtain 40. Track slides 42 are then inserted sequentially into guide track 12. Each end of guide track 12 is then plugged with plugs (not shown). The lower edge of curtain 40 is then secured to the guide channel means 10 of the present invention. Shower curtain 40 in effect becomes a flexible shower door.

FIG. 1 illustrates the shower curtain anchor attachment means of the present invention having guide channel track 10 mounted to the interior side wall of a bathtub 22. In this position, the curtain anchor means 24 attached to the lower edge of shower curtain 40 falls below guide channel track 10 and the nylon track slide shaft 42 is in a substantially vertical position, holding the curtain 40 within bathtub 22.

Figure 2:
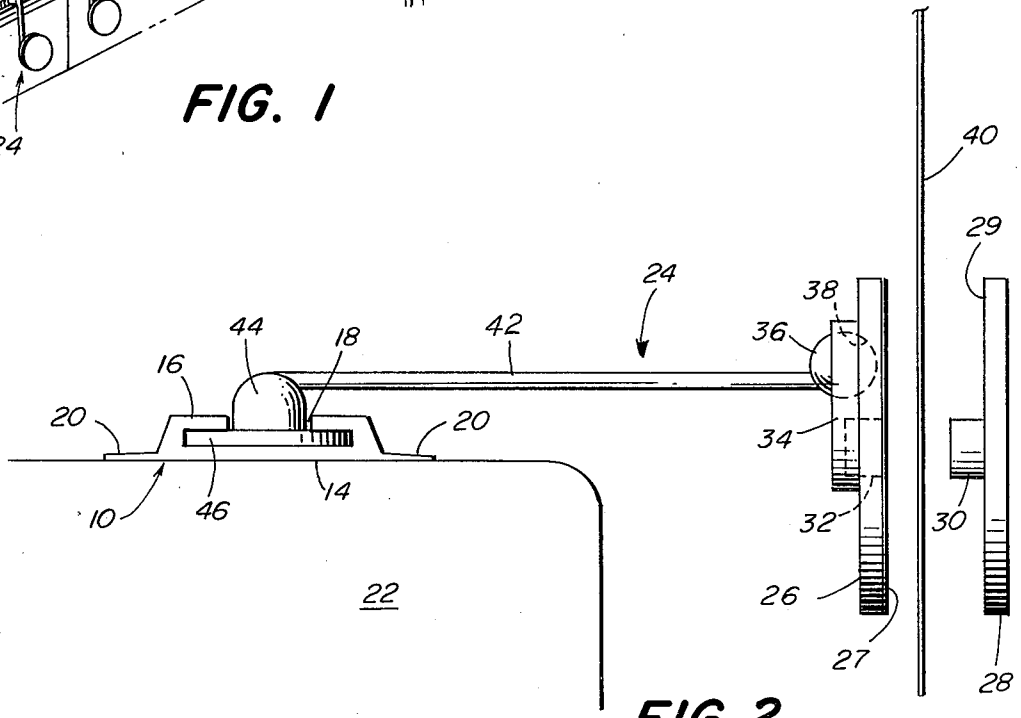
FIG. 2, is an end view of the guide channel track means and an exploded view of the curtain anchor means of the present invention in position on a bathtub enclosure rim, with a conventional shower curtain position indicated.

FIG. 2 illustrates the shower curtain anchor attachment means having guide channel track 10 mounted to the upper rim of bathtub 22. In this position, the curtain anchor means 24 attached to shower curtain 40 are somewhat higher up from the lower edge of curtain 40, being positioned substantially even in the horizontal plane with the guide channel track 10. In this position, the nylon track slide shaft 42 is in a substantially horizontal position, but also holding shower curtain 40 within bathtub 22.

It will be apparent that various changes and modifications may be made in the construction and arrangement of the above-described parts without departing from the scope and spirit of the invention. It is intended that such changes and modifications be included within the scope of the appended claims.

I claim:

1. A shower curtain anchor attachment for securing and guiding the lower edge of a shower curtain to bathtubs and shower enclosures comprising:

a flexible, elongated C-shaped guide track forming an elongated T-shaped channel;

a plurality of curtain anchor means to connect the lower edge of a shower curtain to said guide channel track comprising:

a circular, wafer-like anchor disc cover having a centrally disposed cylindrical protuberance on its interior surface;

a circular, wafer-like anchor disc body having a centrally-oriented depression to snugly receive the protuberance of said anchor disc cover, thereby securing a shower curtain between said anchor disc cover and said anchor disc body;

said anchor disc body having a partial spherically shaped depression on its exterior side to receive a ball joint;

said anchor disc cover and said anchor disc body forming an anchor disc means;

a thin, elongated track connector shaft having a spherically shaped ball joint at one end to be received within the partial spherically shaped depression on said anchor disc body and a circular track slide secured to its other end, said track slide to be slidably received within said channel within said guide channel track means;

said track connector shaft serving to connect said anchor disc means to said guide channel track means such that when said shower curtain is opened and closed, said track slide moves longitudinally within said channel thereby securing the lower edge of said shower curtain in both its opened and closed positions.

2. The shower curtain anchor attachment of claim 1 wherein the rear surface of said guide channel track is coated with an adhesive for installation of said guide channel track.

3. The shower curtain anchor attachment of claim 1 wherein the interior surfaces of said anchor disc cover and said anchor disc body are coated with an adhesive for secure attachment to a shower curtain.

4. The shower curtain anchor attachment of claim 1 wherein said guide channel track means further includes tapered guide channel track edges.

* * * * *